United States Patent [19]

Sekiguchi

[11] 3,941,110

[45] Mar. 2, 1976

[54] IGNITION SYSTEM FOR INTERNAL COMBUSTION ENGINES

[75] Inventor: Tomoaki Sekiguchi, Hamamatsu, Japan

[73] Assignee: Yamaha Hatsudoki Kabushiki Kaisha, Japan

[22] Filed: Dec. 27, 1972

[21] Appl. No.: 319,057

[30] Foreign Application Priority Data

| | | |
|---|---|---|
| Dec. 28, 1971 | Japan | 47-2246 |
| Oct. 31, 1972 | Japan | 47-108453 |
| Oct. 31, 1972 | Japan | 47-125793 |

[52] U.S. Cl. ..... 123/148 CC

[51] Int. Cl.[2] ..... F02P 1/00

[58] Field of Search ..... 123/148

[56] References Cited

UNITED STATES PATENTS

| | | | |
|---|---|---|---|
| 3,500,809 | 3/1970 | Höhne et al. | 123/148 MCD |
| 3,545,420 | 12/1970 | Foreman | 123/148 E |
| 3,554,177 | 1/1971 | Hufton | 123/148 E |
| 3,653,367 | 4/1972 | Oishi | 123/148 E |
| 3,704,701 | 12/1972 | Struber | 123/148 E |
| 3,705,573 | 12/1972 | Palazzetti | 123/148 E |

OTHER PUBLICATIONS

"Electronically Controlling Auto's Engine Spark", Hayes, *Electronics*, Dec. 28, 1964.

*Primary Examiner*—Wendell E. Burns
*Assistant Examiner*—Joseph Cangelosi
*Attorney, Agent, or Firm*—Holman & Stern

[57] ABSTRACT

An ignition system for internal combustion engines which comprises a magneto electric generator having a generating coil for producing two output signals different in phase, a capacitor which will be charged and discharged to operate a high tension coil, a switching element for discharging the capacitor, and a control circuit for controlling the switching element, one of the two output signals charging the capacitor, the other output signal controlling the switching element through the control circuit with the results that the control voltage of the switching element is not affected by the ambient temperature and the ignition system is made smaller in size, is serviceable for preventing excessive rate of rotation of the combustion engine, and can be molded into one unit.

5 Claims, 11 Drawing Figures

IGNITION SYSTEM FOR INTERNAL COMBUSTION ENGINES

BACKGROUND OF THE INVENTION

This invention relates to an ignition system of the capacitor discharge type for internal combustion engines.

In a conventional ignition system, two coils for generating electric current or voltage (hereinafter referred to as "generating coils") are provided in a magneto electric generator which rotates in synchronization with an internal combustion engine, and the capacitor is charged by a voltage induced in one of the two generating coil, and the capacitor thus charged is discharged through the primary winding of an ignition coil when a thyristor is made conductive by a signal voltage which is produced, in synchronization with the ignition timing, by the other generating coil.

However, this conventional ignition system involves the following problems because of the two generating coils. That is, troubles, such as disconnection or breaking of coils, originated from the coils are frequently caused, the dimensions of the generator is inevitably increased greater as much as the volume occupied by the two generator-coils, and the circuit of the ignition system is liable to become intricate.

In general, internal combustion engines whose load is extremely variable are accompanied by excessive rate of rotation whenever its load is removed. For instance, an internal combustion engine for chain saws will rotate at an excessive speed when it has completely sawed through a log because at that moment the internal combustion engine abruptly loses its load. This condition will be caused also in an internal combustion engine of an outboard motor when it jumps. This is undesirable for the operation of internal combustion engines, and several methods such as methods of controlling a throttle valve or ignition have been tried to prevent the trouble.

Furthermore, in small engines (in general, started manually) such as a small all-purpose engine which requires no battery, an ignition system cooperated with a magneto electric generator is employed and the ignition system is preferable to make contact-less by using a semiconductor switch in charging and discharging a capacitor because of its maintenance free. In this case, frequently, a timing detector, an electronic circuit, generating coil and a high tension coil of the ignition system are divided into a few units which are mutually connected by wires. Therefore, this contact-less ignition system is more complicated in handling than a conventional ignition system in which contacts are used for ignition.

In addition, in the conventional ignition system employing a thyristor as its switching element for discharging the capacitor, a voltage between the cathode and the control electrode of the thyristor which is necessary for rendering the thyristor conductive varies with its ambient temperature, as a result of which the ignition timing of the internal combustion engine provided with this ignition system is also varied. Since the ambient temperature is greatly changed during the start period of the engine, the voltage variation due to the variation of the ambient temperature is too great to be neglected.

SUMMARY OF THE INVENTION

Accordingly, a first object of the invention is to provide an ignition system for internal combustion engines in which all of the above described disadvantages accompanied by the conventional ignition system are eliminated.

A second object of the invention is to provide an ignition system for internal combustion engines in which, on the basis that a single coil of a magneto electric generator generates positive and negative voltage outputs, one of the voltage outputs is utilized as a power source for ignition while the other voltage output is utilized as a power source for producing a control signal.

A third object of the invention is to provide a high tension coil for internal combustion engines which is simple in structure, high in reliability, small in size and low in cost.

A fourth object of the invention is to provide an ignition system for internal combustion engines which can quickly prevent excessive rate of rotation of the internal combustion engine.

A fifth object of the invention is to provide an ignition system which can be installed on small internal combustion engines such as those for chain saws.

A sixth object of the invention is to provide an ignition system in which a high tension coil is formed as a high frequency transformer.

A seventh object of the invention is to provide an ignition system for internal combustion engines which is molded into one unit thereby being convenient in handling and installing.

A further object of the invention is to provide an ignition system for internal combustion engines whose operation is not affected by its ambient temperature.

The foregoing objects and other objects of the invention will become more apparent from the following detailed description and the appended claims when read in conjunction with the accompanying drawings, in which like parts are designated by like reference symbols or numerals.

As conducive to a full understanding of this invention, first one example of a conventional ignition system will be described.

DETAILED DESCRIPTION OF THE INVENTION

Figure 1:
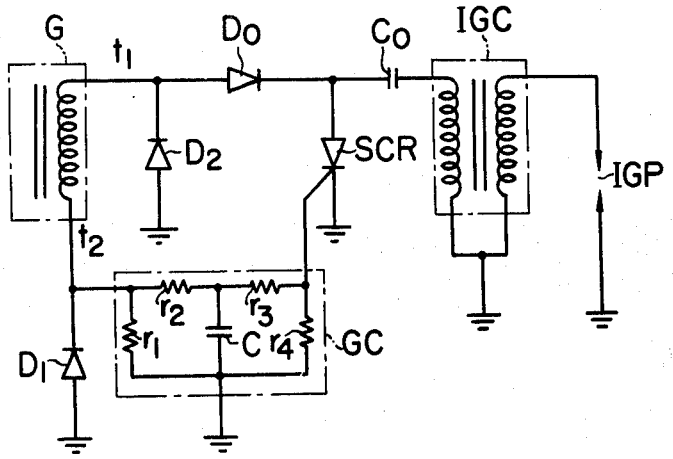
FIG. 1 PRIOR ART
FIG. 1 is a circuit diagram for one example of a conventional ignition system.

Shown in FIG. 1 is one example of the ignition system popularly used for an internal combustion engine which comprises: a magneto electric generator having a coil G for generating electric current or voltage (hereinafter referred to as "a generating coil G"); diodes $D_0$, $D_1$, and $D_2$; a capacitor $C_o$ which will be charged by rectified positive half waves of a voltage generated by the generating coil G; a thyristor SCR adapted to discharge the capacitor $C_o$; a gate circuit GC which, when the voltage of the generating coil GC is of negative half waves, will form a voltage signal with the aid of the action of the diode $D_2$ thereby to make the thyristor SCR conductive; a high tension coil IGC which will produce a high voltage in its secondary winding by discharge of the capacitor $C_o$; and an ignition plug IGP to which a secondary voltage of the ignition coil IGC is applied.

Figure 2:
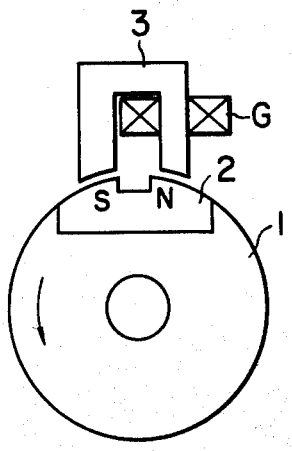
FIG. 2 PRIOR ART
FIG. 2 is a schematic diagram illustrating one example of the electric generator employed in the ignition system shown in FIG. 1.

The magneto electric generator provided for the ignition system is shown in FIG. 2 which comprises: a rotor 1 which will rotate in synchronization with the internal combustion engine; and a stator positioned to have an air gap between the periopheral surface of the stator and a core 3 with the single generating coil G. The rotor 1 is made of magnetic material and has a U-shaped magnet 2 embedded therein in such a manner that its magnetic poles N and S form a part of the circumference of the rotor 1.

As the rotor 1 rotates, the core 3 will form a closed magnetic path with the magnet 2, the magnetic flux changes alternately with change of reluctance of the magnetic path.

In this conventional ignition system, a voltage between the cathode and the control electrode of the thyristor SCR which is necessary for rendering the thyristor SCR conductive varies with its ambient temperature, although the voltage is, in general, on the order of one (1) volt. As a result, the ignition timing of the internal combustion engine is also varied. This voltage variation is too great to be neglected in practical use.

One example of an ignition system for internal combustion engines according to this invention will now be described with reference to FIG. 3, which comprises a capacitor charging circuit which is formed by the ground, a diode $D_1$, a terminal $t_2$ of a generating coil G provided in a magneto electric generator, a terminal $t_1$ of the same, a diode $D_o$, a capacitor $C_o$, a primary winding $IGC_1$ of a high tension coil IGC and the ground; a switching element for discharging the capacitor $C_o$ that is a thyristor SCR in this example, having the anode connected to the connection point of the diode $D_o$ and the capacitor $C_o$ and the cathode grounded; and switching element controlling means which is a circuit 552 formed by a series circuit of resistors $R_{11}$ and $R_{12}$ connected in parallel to the diode $D_1$, a capacitor $C_{11}$ connected in parallel with the resistor $R_{12}$, and a series circuit of a Zener diode ZD and a resistor $R_{13}$ connected in parallel to the capacitor $C_{11}$, the anode of the Zener diode ZD being connected to the control electrode of the thyristor.

To the connection point of the terminal $t_1$ of the generating coil G and the diode $D_o$, a terminal of a stop switch SW and the cathode of a diode $D_2$ are connected. The anode of the diode $D_2$ is grounded. The low voltage side of the secondary winding $IGC_2$ of the high tension coil IGC is connected to a primary winding $IGC_1$ of the high tension coil IGC, while the high voltage side of the secondary winding $IGC_2$ is connected to a high tension terminal 116 of an ignition plug IGP. The generating coil G is magnetically coupled through a gap to a magnet 2 of the rotor 1 which rotates in synchronization with the rotation of the engine, similarly as in FIG. 2.

The operation of the ignition system shown in FIG. 3 will be described in reference with FIG. 4.

Figure 4:
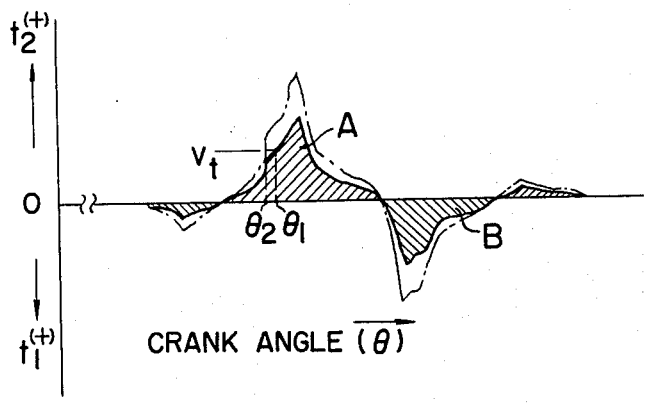
FIG. 4 is a diagram illustrating waveforms of output signals produced by the generator shown in FIG. 2.

The rotor 1 is rotated in synchronization with the rotation of the engine, as a result of which a voltage having a waveform as shown in FIG. 4 is produced.

Figure 3:
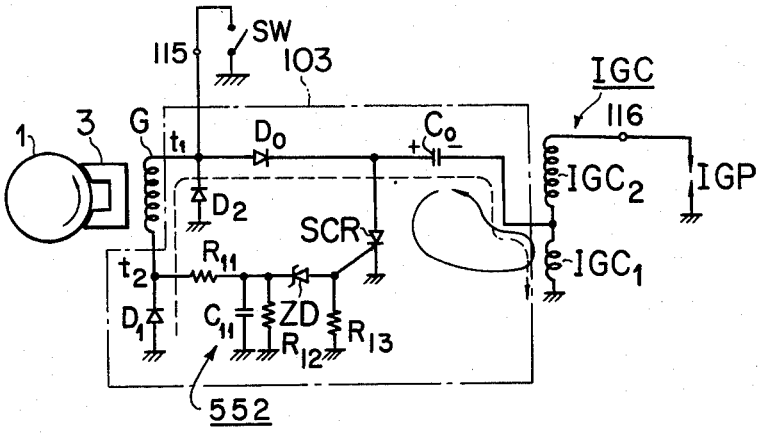
FIG. 3 is a circuit diagram for one example of an ignition system for internal combustion engine according to this invention.

That is, the magneto electric generator driven by the internal combustion engine will produce a voltage having a waveform as shown in FIG. 3. In the waveform, a part A is used as a power source for producing an output signal from the gate circuit for making the thyristor conductive (hereinafter referred to as "a timing signal power source"), and a part B is used as a power source for charging the capacitor $C_o$ to be ready for ignition (hereinafter referred as "a ignition signal power source").

Although this waveform depends on the designs of the magnet 2 of the rotor 1, the core 3 and the gap between the magnet and the core, it is assumed that the waveform as shown in FIG. 4 is obtained, because the designs of these elements are not directly concerned to this invention. Since a voltage generated by the generating coil G is proportional to a rotational number of the rotor 1 and accordingly the rotational number when the waveform indicated by the broken line is obtained is greater than the rotational number when the waveform indicated by the solid line is obtained.

When the voltage is generated to be positive at the terminal $t_1$ of the generating coil G (as indicated by reference character B in FIG. 4), the diodes $D_1$ and $D_o$ are conductive. Accordingly, the capacitor $C_o$ is charged through the capacitor charging circuit described above with an electric current flowing as indicated by a broken arrow line. When the voltage thus generated becomes lower than the voltage of the capacitor $C_o$ thus charged, the diodes $D_1$ and $D_o$ are non-conductive, and accordingly the voltage of the capacitor $C_o$ is maintained unchanged.

Now, when the voltage is generated to be positive at the terminal $t_2$ of the generating coil G (as indicated by reference character A in FIG. 4), the diode $D_2$ is conductive and the terminal $t_1$ is at the ground potential, and the diode $D_1$ is non-conductive. The voltage at the terminal $t_2$ is subjected to voltage division by the resistors $R_{11}$ and $R_{12}$. The voltage thus treated is applied to the Zener diode ZD. When the voltage thus applied exceeds the Zener voltage of the Zener diode ZD, an electric current flows through the Zener diode ZD to the control gate of the thyristor SCR thereby to make the latter conductive. The position of the rotor when the current begins flowing to the control gate of the thyristor SCR is the ignition crank angle. This crank angle will be described with reference again to FIG. 4. It is assumed that when the voltage at the terminal $t_2$ has a value $v_t$, the thyristor SCR is rendered conductive. The ignition crank angle is a crank angle $\theta_1$ in the waveform indicated by the solid line and a crank angle $\theta_2$ in the waveform indicated by the broken line which is obtained in the case of increasing the rotational number of the engine. That is, the ignition crank angle advances with the rotational number of the engine. Thus, an automatic ignition crank angle advancing characteristic of the ignition system is obtained. From the above description, it will be apparent that the relationships between the ignition crank angle advancing quantity and the rotational number of the engine depend on the shape of the leading edge of the part A of the waveform. Accordingly, a desired ignition crank angle advancing characteristic can be obtained by designing the ignition system so that it will produce a proper waveform of this part.

The capacitor $C_{11}$ is to adjust an ignition angle when the engine is rotated at high speed, and the resistor $R_{13}$ is to stabilize the operation of the thyristor SCR.

As was described previously, with the conventional ignition systems, the ignition angle is varied with the variation of the ambient temperature. More specifically, the ignition angle is varied by the fact that the gate trigger voltage of the thyristor SCR is varied by the variation of its ambient temperature. However, since the Zener diode ZD is, according to this invention, employed in the control circuit 552, the variation of the ignition angle can be reduced to the extent that it can be disregarded in practical use. It goes without saying that the Zener diode ZD may be replaced by other elements which function in the same manner as the Zener diode.

The voltage provided at the terminal $t_2$ is several hundreds of volts and is much greater than the gate trigger voltage of the thyristor SCR. Accordingly, the resistance of the resistor $R_{11}$ can be considerably high. Owing to this high resistance, the voltage waveform is scarcely deformed by the current flowing through this resistor $R_{11}$.

When the thyristor SCR is rendered conductive at the proper crank angle described above, the capacitor $C_o$ which has been charged is abruptly discharged through the thyristor SCR and the primary winding $IGC_1$ as indicated by the solid arrow line. As a result, a high voltage pulse is generated in the secondary winding $IGC_2$ of the high tension coil IGC and simultaneously a spark is caused in the ignition plug IGP, thereby to ignite the combustion gas in a cylinder of the engine. In this case, it is not necessary for the high tension coil IGC to store energy and in addition the discharge period of time is extremely short, that is, it is of the order of 100 microseconds. Accordingly, the high tension coil IGC can be made smaller in size and can be formed as a high frequency transformer which will be described in detail later.

If the stop switch connected to the terminal $t_1$ is grounded, the capacitor $C_o$ is no longer charged, thereby to stop the engine.

In this ignition system, the capacitor is charged by positive half waves of the a.c. voltage induced in the generating coil G and the timing signal is produced at the proper position in the waveform of negative half waves of the a.c. voltage thereby to discharge the capacitor thus charged. Therefore, the ignition system according to the invention requires no timing detecting coil provided in the magneto electric generator. In addition, since the high tension coil 104 is adapted to apply to the ignition plug the voltage having a steep rise and a sufficient peak value in the waveform, it follows that all that is necessary for the high tension coil 104 is to form a high frequency voltage, and it is not necessary for the high tension coil 104 to have a low frequency or D.C. characteristic, as a result of which the windings and the core of the high tension coil 104 can be made smaller in size; that is, the external dimensions thereof can be made in the order of 1/5 to 1/6 in volume of those of the conventional high tension coil.

The unnecessariness of the timing detecting coil and the miniaturization of the high tension coil according to the invention lead to another advantage that the ignition system including the electronic circuit can be made into one unit.

If summarizing the advantages of the ignition system shown in FIG. 3;

a. only one generating coil G can be used in common as a capacitor charging power source and a gate signal producing power source;

b. the high tension coil can be made smaller in size;

c. the automatic ignition crank angle advancing characteristic and the stable temperature characteristic can be obtained by the provision of a relatively small number of components; and accordingly d. the ignition system according to this invention can be made smaller in size, and is very convenient in handling and installing.

Thus, the ignition system according to this invention is most suitable for small internal combustion engines.

Figure 5:
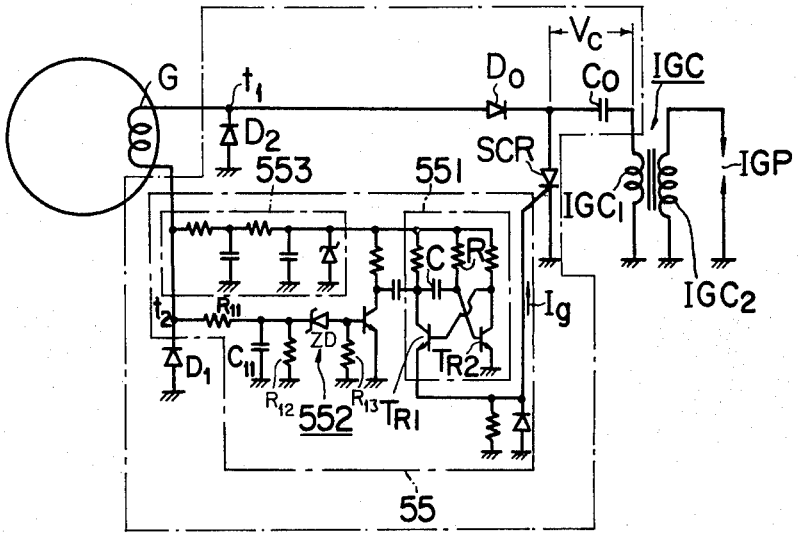
FIG. 5 is another example of the ignition system, according to the invention.

Another example of the ignition system according to this invention is shown in FIG. 5, which comprises the same capacitor charging circuit as in FIG. 3; a switching element for discharging the capacitor $C_o$, that is, a thyristor SCR in this example also, having the anode connected to the connection point of the diode $D_o$ and the capacitor $C_o$; and switching element controlling means 55 for providing a thyristor trigger current Ig which means includes in addition to the circuit 552 described with reference to FIG. 3, a mono-stable multi-vibrator 551 whose output, or trigger signal, is applied to the control electrode of the thyristor SCR, and a power circuit 553 for providing a rectified and smoothed output to the monostable multi-vibrator 551 from an output of the coil G.

The mono-stable multi-vibrator includes a C.R. circuit which extends the duration of the trigger signal to be applied to the thyristor SCR longer as much as defined by a time constant thereof.

Figure 6:
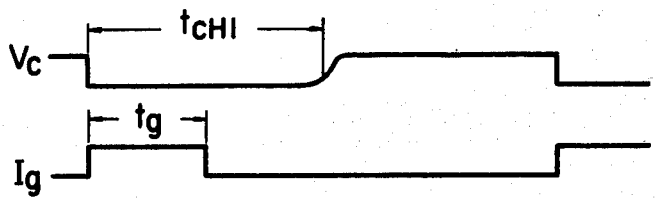
FIG. 6 is a diagram illustrating the relation between a waveform of a capacitor voltage and that of a thyristor trigger current in the period of normal rate of rotation of an internal combustion engine.
Figure 7:
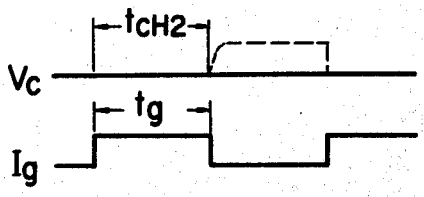
FIG. 7 is a diagram illustrating the relation between a waveform of a capacitor voltage and that of a thyristor trigger current in the period of excessive speed of rotation of an internal combustion engine.

FIG. 6 shows the relation between a waveform of a capacitor voltage $V_c$ and that of a thyristor trigger current $I_g$ in the period during which the generator rotates normally (hereinafter referred to as a normal rotation period), while FIG. 7 shows the relation between the waveforms of the capacitor voltage $V_c$ and the thyristor trigger current $I_g$ in the period during which the generator rotates excessively (hereinafter referred to as an excessive rotation period).

In the normal rotation period, the charge coil G of the a.c. generator periodically produces an a.c. voltage at long time intervals and the capacitor $C_o$ is charged through the diode $D_o$. That is, as is shown in FIG. 6, the charge voltage $V_c$ of the capacitor $C_o$ will rise at the long time interval $tCH_1$. The duration tg of thyristor trigger current $I_g$ is considerably shorter than the long time interval $tCH_1$. Accordingly, charging of the capacitor $C_o$ begins after the thyristor SCR has turned off. In this case, the circuit 55 will have no special operation for the ignition system, and it follows therefore that the ignition plug periodically carry out ignition and the operation of the internal combustion engine is therefore continued at a normal rate of rotation.

In the excessive rotation rate, the charge coil G of the a.c. generator produces an a.c. voltage at short time intervals and the capacitor $C_o$ is also charged through the diode $D_o$. In this case, if the short time intervals become shorter than the duration *tg* of the thyristor trigger current Ig as shown in FIG. 7, the thyristor SCR will remain in the conductive state till charging period, so that the charging current be short-circuted by the thyristor SCR and it continues conductive rate throughout the charging period, whereby the capacitor $C_o$ remains uncharged.

Since this discharge is effected when the short time interval becomes the time interval $tCH_2$ which is shorter than the duration tg of the thyristor trigger current Ig due to the increasing rotation speed of the internal combustion engine, the normal discharge current is very small or does not flow. Consequently, a voltage induced in the secondary winding of the high tension coil IGC is too low or not induced to carry out ignition in the internal combustion engine.

If the thyristor SCR is turned on after the charged voltage of the capacitor has reached its maximum value, the ignition plug IGP will carry out ignition, as a result of which the internal combustion engine tends to maintain its excessive rotation. However, the speed of the internal combustion engine will not be increased so quickly as to maintain the excessive rotation, and therefore the internal combustion engine will not be operated at such an excessive rate or rotation as described.

If a voltage is slowly built up in the capacitor $C_o$, the voltage charged in the capacitor $C_o$ can be discharged early even when the speed of the internal combustion engine is quickly increased therefore, the rising curve of the capacitor charge voltage $V_c$ should have a certain slope. This slope can be obtained by means of a time delay element. However, in practice, no particular means is required for obtaining the slope, because resistance of the generator coil and the diode characteristic can be utilized for this purpose.

Thus, whenever the rate of rotation of the internal combustion engine becomes excessive, the charging of the capacitor $C_o$ will not be carried out and therefore the ignition plug IGP will not cause sparks. As a result, the output of the internal combustion engine will be decreased and its revolution rate will also be decreased.

When the revolution rate of the internal combustion engine is decreased and the capacitor $C_o$ is charged, the ignition plug IGP will carry out ignition again and the internal combustion engine will operate at the normal rotation.

Figure 8A:
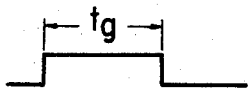
FIGS. 8(*a*), 8(*b*) and 8(*c*) are diagrams illustrating various thyristor trigger currents.
Figure 8B:
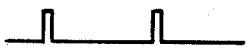
Figure 8C:
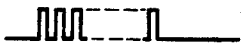

In the examples described above, the trigger current Ig is maintained durable for a certain period, that is, the period *tg* as shown in FIG. 8(*a*). However, the trigger current I*g* may be replaced by two current pulses occurring at the interval *tg* as shown in FIG. 8(*b*) or by many current pulses occurring within the interval *tg* as shown in FIG. 8(*c*).

As is clear from the above description, according to the invention, the a.c. output of the a.c. generator is subjected to rectification, the output thus rectified is used to charge the capacitor, and a trigger signal is applied to the thyristor for a certain period so that the capacitor thus charged be discharged through the high tension coil, it follows therefore that, when the period for charging the capacitor becomes short due to the excessive rate of rotation of the internal combustion engine, the high tension coil will not carry out ignition and therefore the excessive rate of rotation of the internal combustion engine can be prevented.

In addition, since the component to be added to the conventional ignition system is only the circuit 55 for extending the duration of the trigger signal, it follows that the size of the ignition system will not be increased and the invention can be applied also to small internal combustion engines such as chain saws and internal combustion engines to be installed outboard motor. Furthermore, if in view of the above described operation for preventing the excessive rate of rotation of the engine, the above described ignition control is carried out, with a throttle valve being set for excessive rotation, the internal combustion engine can be controlled constant in rate of rotation.

It is apparent that the same effects obtained by the first example shown in FIG. 3 can also be obtained by the second example shown in FIG. 5.

Hereinafter, another aspect of the present invention will be described in which an ignition system for internal combustion engines is molded into one unit thereby being convenient in handling and installation.

Figure 9:
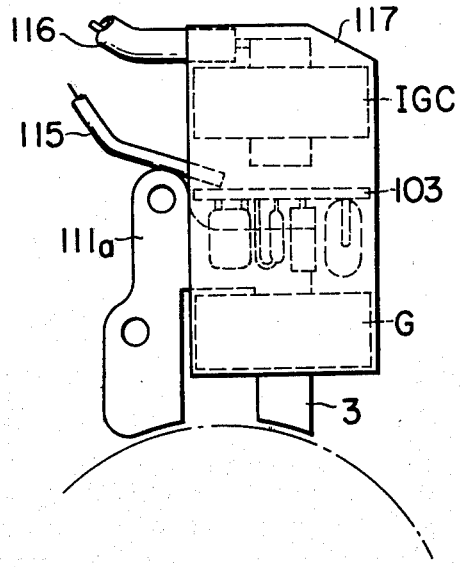
FIG. 9 is a schematic diagram illustrating a structure of an ignition system molded into one unit according to the invention.

Shown in FIG. 9 is one example of the ignition system which has been molded with resin into one unit. The example comprises a core 3 positioned in the vicinity of a rotor having the magnet, with a mounting member 111*a*, a generating coil G wound on the core 3, an electronic circuit 103 arranged above the core 3, a stopswitch line 115 for connecting the electronic circuit 103 to a stop switch (not shown), a high voltage output line 116 for connecting a high tension coil IGC to an ignition plug (not shown), a resin 7 for molding the generating coil G, electronic circuit 103, and high tension coil IGC which are properly wired and positioned.

The elements to be molded are arranged in the proper mold, and resin 117 is then poured in it and hardened.

As is apparent from the above descriptions, since the timing signal is obtained from the generating coil and the high tension coil has only the high frequency characteristic, the timing detecting coil can be omitted from the ignition system and the high tension coil can be made smaller in size, with the result that the ignition system can be molded into one unit with resin. This leads to convenience in handling and installing the ignition system. Furthermore, the molding of the elements of the ignition system has improved the characteristic of the ignition system such as dust-proof, waterproof, moisture-proof and shock-proof, which results in improvement in the reliability thereof. In addition, the unification of the ignition system is convenient in repair of replacement when it is out of order.

I claim:

1. An ignition system for internal combustion engines, which comprises:

an internal combustion engine;

a generating coil provided in an electric generator which is rotated in synchronization with the internal combustion engine;

a capacitor connected to said generating coil so as to be charged by an output of the generator which is developed over the generating coil;

a switching element connected in parallel with said coil and with said capacitor for controlling the charge and discharge of the capacitor;

a switching element controlling means for controlling the operation of the switching element, which means include a device for minimizing the variation of the operating voltage of the switching element and a diode connected to the generating coil so as to control the operation of said device; and in which said switching element controlling means further comprises a monostable multi-vibrator whose output is applied as a trigger signal to the switching element thereby to render the latter conductive, said monostable multi-vibrator being controlled by the operation of said device for minimizing the variation of the operating voltage of the switching element.

2. An ignition system for internal combustion engines, which comprises:

an internal combustion engine;

a generating coil provided in an electric generator which is rotated in synchronization with the internal combustion engine;

a capacitor connected to said generating coil so as to be charged by an output of the generator which is developed over the generating coil;

a switching element connected in parallel with said coil and with said capacitor for controlling the charge and discharge of the capacitor;

a switching element controlling means for controlling the operation of the switching element, which means include a device for minimizing the variation of the operating voltage of the switching element and a diode connected to the generating coil so as to control the operation of said device; and in which said switching element is a thyristor and said device is a Zener diode operating in such a manner that when the output of said generator exceeds the Zener voltage of said diode, the output is applied as a trigger signal through the Zener diode to the control electrode of the thyristor thereby to render the latter conductive, said system being molded into one unit together with a high tension coil connect to said capacitor.

3. An ignition system as claimed in claim 2 in which said high tension coil comprises a high frequency transformer.

4. An ignition system as claimed in claim 1, in which said mono-stable multi-vibrator includes a C.R. circuit to extend the duration of the trigger signal to be applied to the switching element longer as much as defined by a time constant thereof.

5. An ignition system for internal combustion engines, which comprises:

an internal combustion engine;

a single generating coil provided in an electric generator which is rotated in synchronization with said internal combustion engine and which provides an alternating current voltage output;

a capacitor connected to said generating coil, so as to be charged and discharged by an output of said generator which is developed over the generating coil;

a thyristor connected in parallel with said generating coil and with said capacitor for controlling the charge and discharge of the capacitor;

a switching element controlling means for controlling the operating of said thyristor, which means includes a Zener diode connected to the control electrode of said thyristor for minimizing the variation of the operating voltage of said thyristor and a diode connected to said generating coil so as to control the operation of said Zener diode; and said connections being such that one half wave of said generator output voltage flows through said diode connected to said generating coil to charge said capacitor, with the succeeding half wave of said voltage not flowing through said diode but, when said voltage developed by said generating coil exceeds the Zener voltage of said Zener diode, flowing through said Zener diode as a trigger signal to the control grid of said thyristor to render said thyristor conductive to discharge said capacitor.

* * * * *